US006357429B1

(12) United States Patent
Carnevale et al.

(10) Patent No.: US 6,357,429 B1
(45) Date of Patent: Mar. 19, 2002

(54) DEVICE FOR ESTIMATING RICHNESS IN AN INJECTION SYSTEM FOR AN INTERNAL COMBUSTION ENGINE

(75) Inventors: Claudio Carnevale, Port Cergy; Mourad Hadji, Cergy, both of (FR)

(73) Assignee: Sagem SA, Paris (FR)

( * ) Notice: Subject to any disclaimer, the term of this patent is extended or adjusted under 35 U.S.C. 154(b) by 0 days.

(21) Appl. No.: 09/600,264

(22) PCT Filed: Jan. 15, 1999

(86) PCT No.: PCT/FR99/00072

§ 371 Date: Jul. 13, 2000

§ 102(e) Date: Jul. 13, 2000

(87) PCT Pub. No.: WO99/36690

PCT Pub. Date: Jul. 22, 1999

(30) Foreign Application Priority Data

Jan. 19, 1998 (FR) ..... 98/00502

(51) Int. Cl.[7] ..... F02D 41/36

(52) U.S. Cl. ..... 123/673; 701/103; 701/104; 73/117.3

(58) Field of Search ..... 123/673; 701/103, 701/104; 73/117.3

(56) References Cited

U.S. PATENT DOCUMENTS 5,548,514 A * 8/1996 Hasegawa et al. ..... 123/673
5,657,736 A * 8/1997 Maki et al. ..... 123/673
5,983,874 A * 11/1999 Suzuki et al. ..... 123/673
6,029,641 A * 2/2000 Suzuki ..... 123/673

* cited by examiner

*Primary Examiner*—Erick Solis
(74) *Attorney, Agent, or Firm*—Larson & Taylor PLC

(57) ABSTRACT

The apparatus for estimating the richness of the mixture admitted into each of the n combustion chambers of an engine having injectors comprises a sensor (26) supplying an output signal that varies in substantially linear manner with richness and that is placed at the junction point between the exhausts from the chambers, and also comprises calculation means. These means store a model of the behavior of the exhaust at the junction point based on the assumption that the richness at the junction point is a weighted sum of contributions from the exhausts from the individual chambers, with the weighting coefficient being smaller with increasing age of the combustion in the chamber, and serving on each pass through top dead center to estimate the air/fuel ratio on the basis of the measured values and of the model. The behavior model includes a submodel specific to each combustion chamber and having, for the chamber of order i, a Kalman filter having a coefficient matrix $C_{ij}$ and a specific gain matrix $K_{ij}$, where i corresponds to the number of the chamber and j corresponds to the number of the weighting coefficient.

5 Claims, 3 Drawing Sheets

DEVICE FOR ESTIMATING RICHNESS IN AN INJECTION SYSTEM FOR AN INTERNAL COMBUSTION ENGINE

The invention relates to systems for injecting fuel into the combustion chambers of an internal combustion engine, and in particular a spark-ignition engine; the invention relates particularly to apparatus for estimating the air/fuel ratio admitted into the combustion chambers usable in such systems.

In particular, apparatus is known for estimating the richness of the mixture admitted into each of the n combustion chambers (where n is an integer greater than 1 and generally equal to 4, 6, or 8) of an engine having injectors for injection into the cylinders, the apparatus comprising:

a sensor providing an output signal which varies substantially linearly with richness, the sensor being placed at a junction point between the exhausts from the n chambers; and computer means for:

storing a model of the behavior of the exhaust at the junction point based on the assumption that the richness at the junction point, i.e. the air/fuel ratio, is a weighted sum of the contributions of the exhausts from the individual chambers, the weighting coefficients decreasing with increasing age of combustion in the chamber, and after each pass through top dead center, estimating the air/fuel ratio from the measured values and of the model.

Such apparatus is described, for example, in U.S. Pat. No. 5,548,514 or in document EP-A-0 719 922, to which reference can be made.

Such apparatus is suitable for use in particular in an injection system of the kind shown diagrammatically in FIG. 1. The diagram shows an engine 10 having n=4 combustion chambers, each provided with a respective injector 12. The air admitted through a filter 14 passes through a butterfly valve 16 prior to reaching an admission manifold 18. The exhaust gases leave the chambers via individual tubes which are connected together at a junction point leading to an exhaust manifold 20.

The quantities of fuel delivered to each cylinder at injection instants are determined by a computer 21 on the basis of operating parameters which can comprise, in particular:

the angular position of the butterfly valve 16 as measured by a sensor 22;

the pressure in the admission manifold, as measured by a sensor 24;

the temperature θ of the cooling water and/or of the exhaust gases; and the output signal from a sensor 26 for measuring richness, which sensor is located at the junction point.

The injection instants are fixed to be in advance relative to passes through top dead center in each combustion chamber, by using a synchronizing signal supplied by a sensor 28 facing the flywheel 30 of the engine 10.

A simple model for representing the richness as measured at the junction point consists in associating the measurement performed by the sensor 26 at a plurality of successive passes of the combustion chambers through top dead center, with respective weighting coefficients that are a function solely of the age of the pass in the operating cycle of the engine. The input to the model is the richness of the mixture admitted to the combustion chamber that has just passed through top dead center (the current cylinder). The puffs of exhaust towards the junction point are combined with one another to represent the gas mixture.

There also exists dispersion between the characteristics of the injectors, such that injection of given determined duration does not correspond to the same quantity of fuel being injected into each of the various chambers.

In the case of four combustion chambers, for example, the sensor is associated with a vector of coefficients $C_i$ where $i=\{1, 2, 3, 4\}$, with $C_4$ corresponding to the current cylinder and with the other, smaller coefficients corresponding to the other cylinders in reverse order of ignition.

That solution is not totally satisfactory because exhaust pipework is generally not symmetrical.

The present invention particularly intends to provide estimation apparatus that satisfies practical requirements better than previously-known apparatuses because it greatly reduces the effects of asymmetries, and specifically, in the event of asymmetry, the invention improves the correction for dispersion in the characteristics of the injectors.

To this end, the invention provides, particularly, apparatus in which the behavior model includes a submodel specific to each combustion chamber and comprising, for each chamber of order i, a Kalman filter having an m×n matrix of coefficients $C_{ij}$ and a matrix of specific gains $K_{ij}$, where i is equal to $\{1, \ldots, n\}$ and corresponds to the number of the chamber, and where j lies in the range 1 to m and corresponds to the number of the weighting coefficient. In other words, the invention proposes a different model for each chamber i, as defined by a set (j) of m coefficients, where m may be equal to n.

Such apparatus which makes it possible to avoid the effect of the exhaust being asymmetrical, also has the advantage of greatly reducing the effect of dispersions in the characteristics of the injectors, and consequently makes it possible to use injectors that have been machined with lower precision.

The model can be represented by one or more matrices $(C_{ij})\lambda$, each corresponding to an operating zone λ of the engine as determined by one or more parameters selected from load range, exhaust gas temperature, cooling water temperature, engine speed, and pressure in the admission manifold.

Which matrix is selected can also depend on the set richness given by the computer, and it can depend on the operating conditions of the engine and on constraints concerning pollution or drivability.

The above characteristics and others will appear better on reading the following description of a particular embodiment, given by way of non-limiting example. The description refers to the accompanying drawings, in which:

FIG. 1, described above, is a diagram showing the elements of an engine to which the invention applies;

Figure 1:
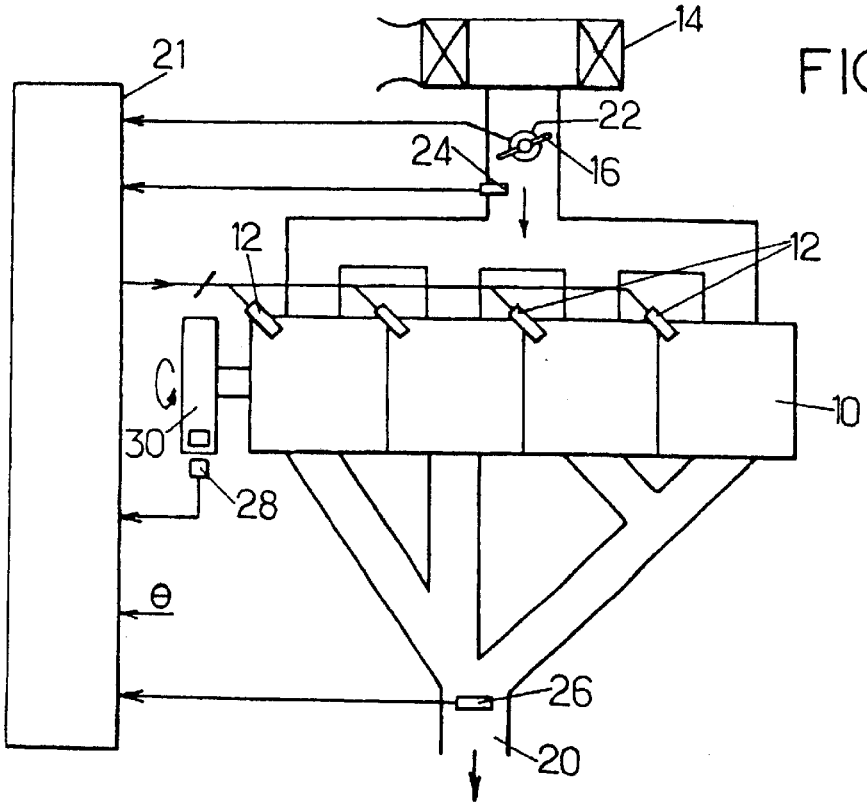
Figure 2:
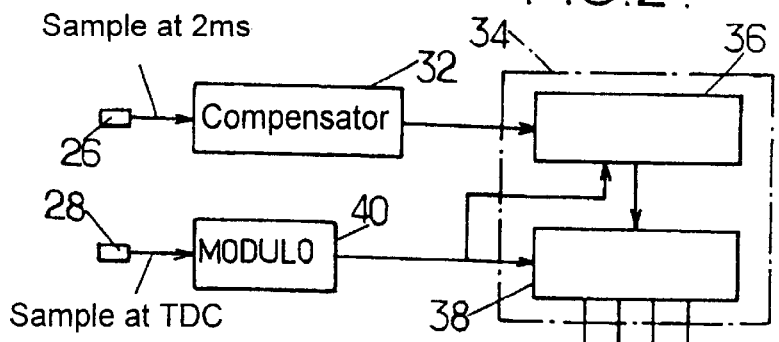
FIG. 2 is a block diagram showing the main subassemblies of apparatus of the invention, and the functions of these subassemblies can be implemented in hardware or in software.

The apparatus of the invention has the structure outlined in FIG. 2. Most of its functions are performed by the computer 21. However, some of the functions, and in particular filter functions having unvarying characteristics, can be implemented in analog form by hard-wired circuits.

The apparatus includes a compensator 32 for compensating the delay introduced by the sensor 26. Synchronous richness acquisition means 34 can be considered as having an observer 36 with Kalman filtering and correction means 38 outputting the air/fuel ratios admitted into the chambers during the cycle that has just elapsed. To allocate richnesses to the appropriate chambers, the correction means receive a synchronizing signal constituted by the output from the sensor 28 followed by a circuit 40 for modulo-n division, with n being equal to 4 in this case.

Synchronization must be initialized, since the sensor 28 cannot tell which combustion chamber has just passed top dead center. This initialization can be performed by various known methods.

Finally, management means 42 determine the length of time for which the injectors 12 are open on the basis of information generated by the computer 21, e.g. constituted by the admitted air flow rate and by the required richness, and on the basis of corrections supplied by the means 38.

The model enabling the synchronous acquisition means 34 to determine the richness of the mixture admitted into each chamber relies on the measurements supplied by the sole sensor 26 situated at the junction point. After each pass through top dead center, it is important to have a measurement representative of richness when a combustion chamber has just gone through top dead center. Unfortunately, conventional sensors introduce measurement delay, in particular because they include a pierced cap for protecting the probe.

Various setups are already known for compensating measurement delay. However, it is advantageous to use the compensation means shown diagrammatically in FIG. 3, which are applicable not only to the Synchronous acquisition means described below, but also to synchronous acquisition means of any other type known previously.

Figure 3:
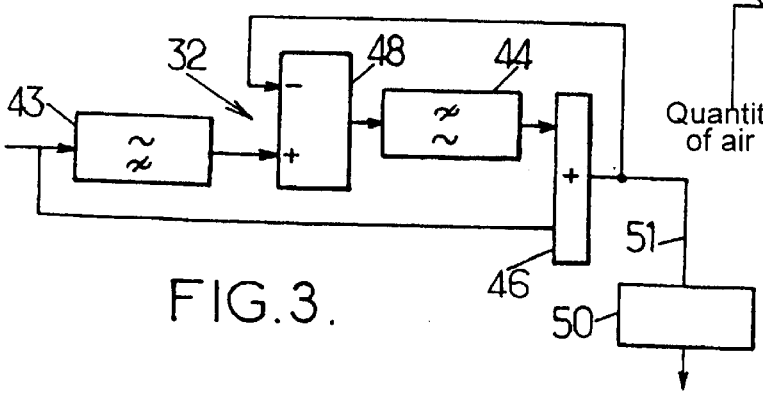
FIG. 3 is a block diagram of means for compensating for the measurement delay introduced by the richness sensor.

The strategy adopted is shown functionally in FIG. 3. The signal coming from the probe is submitted to highpass filtering 43 having characteristics that take account of the time constant $\tau$ of the cap of the sensor which is several tens of milliseconds (ms). To ensure that filtering is stable, the filter taken into account in the highpass filter is associated with the shortest of the time constants amongst those that can be encountered under the various operating conditions of the engine.

The highpass filter 43 amplifies noise which is attenuated or eliminated by a counterfeedback loop that includes lowpass filtering 44, an adder 46 receiving the output from the lowpass filtering and an input signal, and a subtracter 48.

This provides measured and compensated richness information which can be stored in a read/write memory 50 which may optionally be organized as a shift register.

In practice, the functions shown in FIG. 3 are implemented digitally. The output current from the sensor 26 is sampled at a rate which can be about once every 2 ms. Overall the filtering can be designed to implement an inversion function of the following form:

$$G(s)=[1+cap^{-1}(s).\text{lowpass}(s)]/[1+\text{lowpass}(s)]$$

In this expression, the inversion function $cap^{-1}(s)$ can have the following form, where $\beta$ designates a pole:

$$cap^{-1}(s) = \tau \times \beta \times \frac{s + (1/\tau)}{s + \beta}$$

Figure 3A:
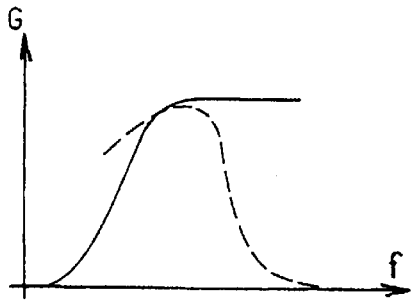
FIG. 3A shows typical response curves for the means of FIG. 3.
Figure 3B:
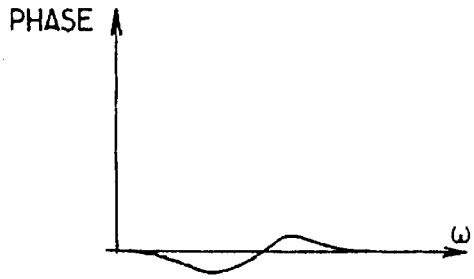
FIG. 3B shows a phase response curve as a function of frequency.

The highpass and lowpass filtering introduces various gains which are designed so that these gains vary as a function of frequency following relationships which can be those outlined respectively by the solid line curve and by the dashed line curve in FIG. 3A. The lowpass filtering can be merely first-order filtering.

Since compensation is performed digitally on discrete values, it can suffice to perform an Euler transform.

The conventional notation can be used:

x(k): state variable;

u(k): measured value;

y(k): output value;

k: instant under consideration (2 ms sampling, for example);

the cap inversion function is:

$$\begin{cases} x(k+1) = (1-\beta)\times x(k) + \beta(1-\tau\beta)\times u(k) \\ y(k) = x(k) + \tau\beta\times u(k) \end{cases}$$

and the lowpass filtering becomes:

$$\begin{cases} x(k+1) = (1-\theta)\times x(k) + \theta\times u(k) \\ y(k) = x(k) \end{cases}$$

In the second formula, $\theta$ designates the lowpass filter gain for disposing of the high frequency noise generated or amplified by the inversion highpass filtering.

At the output from the compensator 32, a richness card is provided which enables instantaneous richnesses to be determined as a function of the instantaneous compensated signal.

The richnesses as measured and compensated in this way are used as inputs for the Kalman filter observer 36.

At present, Kalman filtering is generally performed by adopting the same Kalman gain and the same weighting regardless of the combustion chamber whose richness is to be determined.

According to an aspect of the invention, an optimum anticipation Kalman gain $K_{ij}$ and a set of weighting coefficients C are determined for each of the combustion chambers.

Figure 4:
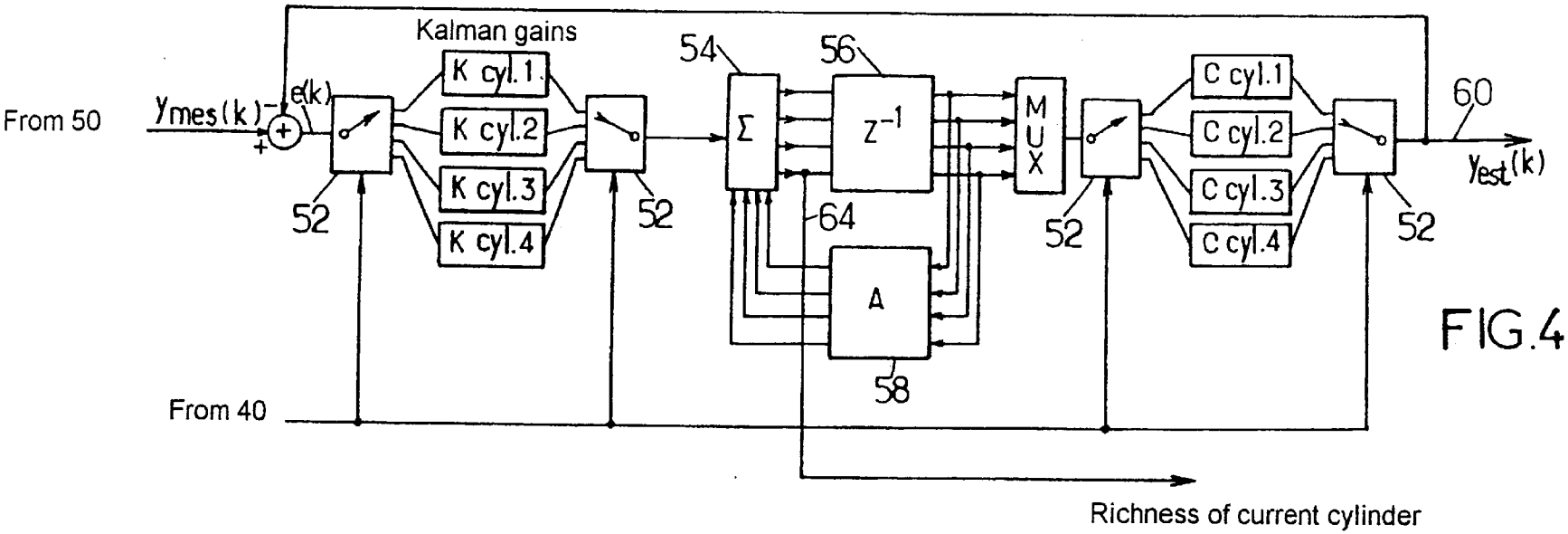
FIG. 4 is a functional diagram of means for acquiring richness synchronously, combustion chamber by combustion chamber.

The functional diagram of the observer can then be as shown diagrammatically in FIG. 4. This observer can be considered as being constituted by n=4 individual observers.

Each of the individual observers can be of relatively conventional structure. By calculation, it is possible for example to determine the richness of cylinder 1 corresponding to switches 52 being in the positions shown in FIG. 4, with the switches in fact being constituted by a program that enables gains and coefficients to be permutated for calculation purposes.

The successive measurements $y_{mes}$ (k) at the junction point are accumulated at 54 and are processed by a $z^{-1}$ operator at 56 whose output is returned to the accumulation via a loop 58 of gain A.

The data obtained at the ends of the top dead centers of n=4 successive cycles are multiplied by the weighting coefficients ($C_{ij}$) corresponding to cylinder i. The value $y_{est}$ (k) obtained at the output 60 is representative of the richness estimated at the junction point. It is reinserted in an input subtracter 62 so as to generate an error signal e(k) which is applied to the input of the Kalman filtering.

The equations representative of the estimate, for a given cylinder, are then as follows: using the same notation as in FIG. 4 and where X(k) designates the state variable.

$$e(k) = y_{mes}(k) - y_{est}(k)$$

$$E_{KALMAN}(k) = G_{KALMAN} \otimes e(k)$$

$$\begin{cases} X(k+1) = A \otimes X(k) + E_{KALMAN}(k) \\ y_{est}(k) = C \otimes X(k) \end{cases}$$

$$\text{with } A = \begin{bmatrix} 0 & 1 & 0 & 0 \\ 0 & 0 & 1 & 0 \\ 0 & 0 & 0 & 1 \\ 1 & 0 & 0 & 0 \end{bmatrix}$$

The weighing coefficients $C_{ij}$ can be obtained experimentally by identification using a measuring bench having a set of probes capable of measuring the richnesses in each of the tubes and the richness at the junction point.

The richness of the current cylinder is thus available that the output 64 of the accumulator 54.

For a given cylinder, several full sets will often be provided each comprising a Kalman gain $K_{ij}$ and a set of weighting coefficients $C_{ij}$, each full set being associated with a particular zone of engine operation.

Figure 5:
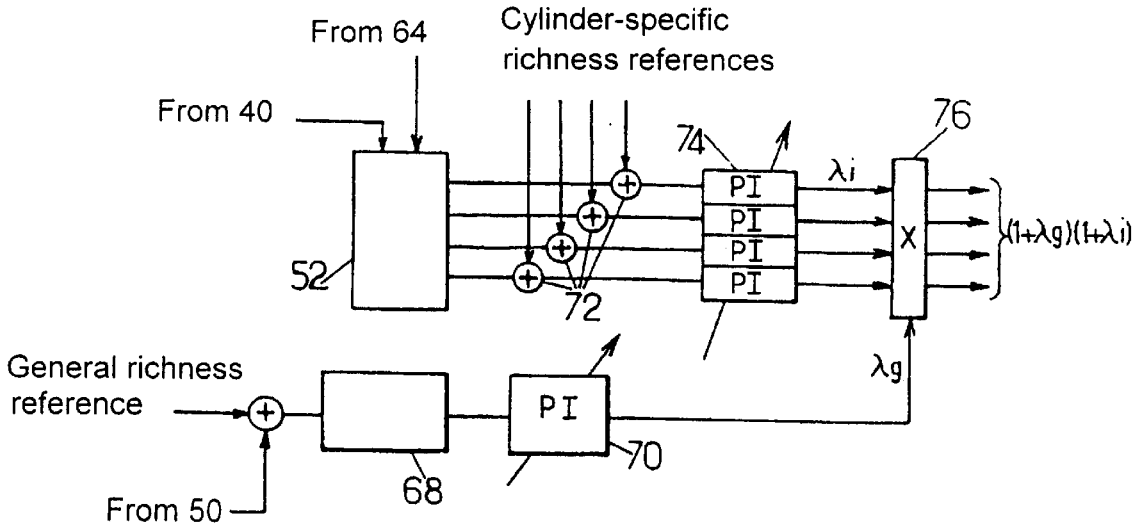
FIG. 5 is a diagram of richness correction means.

Corrections can be generated in application of the functional diagram of FIG. 5. As inputs, the correction means receive:

- the measured and compensated richness signal at the junction point, as obtained from the memory 50;
- signals giving the estimated richness of the current cylinder, coming from output 64 of the observer; and
- the synchronization signal coming from the modulo 4 divider 40.

The richness correction to be applied to a cylinder that is to be determined is computed in the form of a product of two terms:

- a term $1+\lambda_g$ where $\lambda_g$ is a general correction percentage relating to the richness measured at the junction point; and
- a term $1+\lambda_i$ specific to the cylinder of order i, into which injection is to be controlled.

The first term is determined on the basis of an error signal provided by a subtracter 66 which receives both a signal representative of the reference richness (which depends on the operating conditions of the engine), and the output signal coming from the memory 50. An error control module 68 generates a correction term which is processed by a proportional-integral filter 70 for stabilizing the system. This provides $\lambda_g$.

Each of the terms $\lambda_i$ is generated by means of a subtracter 72 which receives both the output signal 64 modulo 4, as generated by a switch 5, and a richness reference signal specific to the cylinder.

The set richness signal can be the same for all of the cylinders. However the set richness can also be different depending on the cylinder.

The resulting error signal is again subjected to proportional-integral filtering 74, known as PI filtering, so as to obtain a correction term $\lambda_i$. A circuit 76 serves to generate the product $(1+\lambda_i)$ $(1+\lambda_g)$ which constitutes a correction factor concerning the duration of injection for cylinder i.

The function of the PI filtering is to compensate for the time taken by the gases to travel between the injection points and the junction point.

The richness error management module 68 serves in particular to make switching of the sensor faster by acting on the error injected into the PI filter 70. In addition to amplifying the richness error, it introduces hysteresis, causing the sensor to switch over only above stoichiometric values when going towards a rich mixture and below stoichiometric values when returning towards a lean mixture. Beyond such changeovers, the management module has a response that is substantially proportional.

The proportional and integral gain factors $K_p$ and $K_i$ of the correction filters 74 are selected as a function of the travel delay between the injectors and the richness sensor, measured as a count of top dead centers:

- $K_p$ is generally less than 1 so as to attenuate high frequencies;
- $K_i$ can be of the form:

$K_i = K_p \times P \times (2/\text{delay time})$ for a 4-cylinder engine. P is an adjustable constant for adjusting dynamic range.

Finally, the management circuit 42 (FIG. 2), makes it possible, on the basis of an input signal 78 indicating the quantity of air admitted into the cylinder and the correction term received from the means 36, to modify the basic injection time corresponding to the set richness so as to set the time during which each of the injectors 12 is opened and so as to control the injector. This circuit can comprise a digital computation portion incorporated in the computer 21 and an analog power portion delivering the current pulses for driving the injectors.

Figure 6:
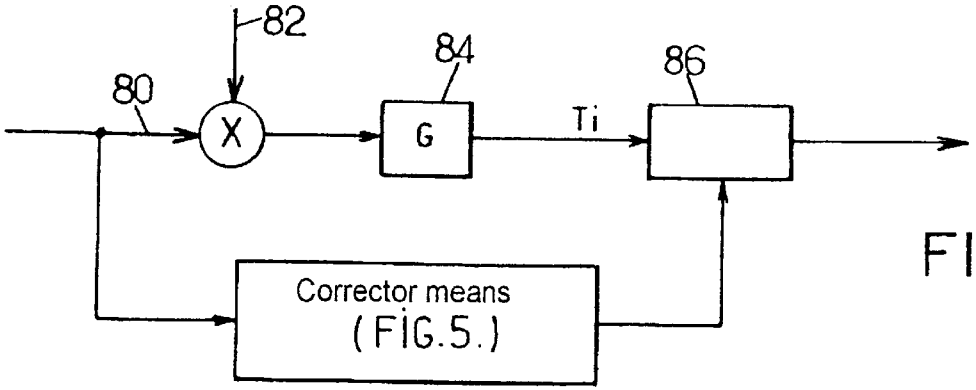
FIG. 6 shows a richness error management block incorporating the means of FIG. 5.

The richness management circuit can correspond to the block diagram of FIG. 6. The richness reference for injector i is applied to input 80 and multiplied by a signal 82 representative of the quantity of air admitted. The product is multiplied by the gain of the injector at 84 to obtain a basic injection time $T_i$. In the module 86, the correction signal supplied by the means of FIG. 5 is used to supply $T_i(1+\lambda_i)$ $(1+\lambda_g)$.

To set up the model, it is necessary for the weighing coefficients to be determined for a given engine. This can be done on a test bench by temporarily fitting the engine with richness probes at the outlet from each cylinder in addition to the final sensor.

The strategy for establishing the richness reference, from starting cold, and as stored in the computer 21, can be as follows:

- immediately after the engine has been cranked, selecting a richness in excess of the stoichiometric value for optimizing the end of starting and the beginning of running, with richness being a function of the temperature of the cooling liquid so that the lower the temperature the greater the richness;
- at the end of an initial period (e.g. 21 seconds), calculating an air/fuel ratio corresponding to a lean "limit" and calculating the duration of a pause during which this value is maintained solely as a function of the temperature of the cooling liquid (assumed to be representative of the state of the catalyst);
- decreasing in quasi-exponential manner towards the lean limit so as to reduce pollution, followed by a pause; and
- at the end of the pause, during which the catalyst heats up, returning towards stoichiometric values, in application of a relationship which can be linear in order to ensure drivability; the rate of increase can be calibrated.

What is claimed is:

1. Apparatus for estimating the richness of the mixture admitted into each of n combustion chambers (n being an integer greater than 1) of an engine having injectors for injection into the cylinders, the apparatus comprising:

a sensor providing an output signal which varies substantially linearly with richness, the sensor being placed at a junction point between the exhausts from the n chambers; and computer means for:

storing a model of the behavior of the exhaust at the junction point based on the assumption that the richness at the junction point, i.e. the air/fuel ratio, is a weighted sum of the contributions of the exhausts from the individual chambers, the weighting coefficients decreasing with increasing age of combustion in the chamber, and after each pass through top dead center, estimating the air/fuel ratio on the basis of the measured values and of the model;

the apparatus being characterized in that the behavior model includes a sub-model specific to each combustion chamber and comprising, for each chamber of order i, a Kalman filter having an m×n matrix of coefficients $C_{ij}$ and a matrix of specific gains $K_{ij}$, where i is equal to {1, . . . , n} and corresponds to the numbering of the chamber, and where j lies in the range 1 to m and corresponds to the numbering of the weighting coefficient.

2. Apparatus according to claim 1, characterized in that each sub-model is associated with a plurality of sets of matrices and gains each corresponding to operating zones of the engine as determined by one or more parameters including load range, exhaust gas temperature, cooling water temperature, engine speed, and pressure in the admission manifold.

3. Apparatus according to claim 1, characterized in that the richness sensor comprises, in addition to a probe (26) placed at the junction point, means for compensating the response delay of the probe, said means comprising a highpass filter (42) followed by a counterfeedback loop having a lowpass filter (48), an adder (46) receiving the output from the lowpass filter and the input signal coming from the probe, and a subtracter (48) receiving the output signal from the adder and the output signal from the highpass filter, feeding the lowpass filter.

4. Apparatus according to claim 3, characterized in that the compensation means are digital, in that the highpass filter functions are of the form:

$$\begin{cases} x(k+1) = (1-\beta)\times x(k) + \beta(1-\tau\beta)\times u(k) \\ y(k) = x(k) + \tau\beta\times u(k) \end{cases}$$

while the lowpass filtering is of the form:

$$\begin{cases} x(k+1) = (1-\theta)\times x(k) + \theta\times u(k) \\ y(k) = x(k) \end{cases}$$

where:

x(k): state variable;

u(k): measured value;

y(k): output value;

k: instant under consideration;

θ=lowpass filter gain;

β=filter pole.

5. A system for injecting fuel into the combustion chambers of an internal combustion engine, the system comprising:

apparatus according to claim 1;

a richness error management module receiving the output signal from the richness sensor and subjecting it to proportional-integral filtering so as to form a general correction term $\lambda_g$;

an adjustable filter (74) allocated to each combustion chamber, receiving the difference between the output from the estimator means corresponding to said chamber and a reference specific to the chamber, so as to supply a correction factor $\lambda_i$ specific to the chamber;

a multiplier (76) providing the product of $(1+\lambda_g)$ and $(1+\lambda_i)$; and a management circuit controlling the injectors on the basis of a signal representing the quantity of air sucked in and on the output from the multiplier.

* * * * *